US006612369B1

(12) United States Patent
Rocha et al.

(10) Patent No.: US 6,612,369 B1
(45) Date of Patent: Sep. 2, 2003

(54) UMBILICAL TERMINATION ASSEMBLY AND LAUNCHING SYSTEM

(75) Inventors: Ralph P. Rocha, Houston, TX (US); Travis M. Bordman, Houston, TX (US); Michael J. Galyen, Sealy, TX (US); Paul J. Drouet, Cypress, TX (US); John A. Sweeney, Cypress, TX (US); Mark B. Means, Missouri City, TX (US)

(73) Assignee: Kvaerner Oilfield Products, Houston, TX (US)

( * ) Notice: Subject to any disclaimer, the term of this patent is extended or adjusted under 35 U.S.C. 154(b) by 0 days.

(21) Appl. No.: 09/895,620

(22) Filed: Jun. 29, 2001

(51) Int. Cl.[7] ..... E21B 29/12; E21B 7/12

(52) U.S. Cl. ..... 166/363; 166/339; 166/341; 166/349

(58) Field of Search ..... 166/338, 340, 166/341, 349, 363, 348, 352

(56) References Cited

U.S. PATENT DOCUMENTS

| | | | | | |
|---|---|---|---|---|---|
| 2,923,531 | A | * | 2/1960 | Bauer et al. | 175/7 |
| 3,047,078 | A | * | 7/1962 | Postlewaite | 175/7 |
| 3,129,774 | A | * | 4/1964 | Armstrong | 166/354 |
| 3,236,302 | A | * | 2/1966 | Postlewaite | 166/341 |
| 3,236,308 | A | * | 2/1966 | Leake | 166/338 |
| 3,315,742 | A | * | 4/1967 | Nicolson | 166/338 |
| 3,424,242 | A | * | 1/1969 | Triplett | 166/341 |
| 3,554,277 | A | * | 1/1971 | Bauer et al. | 166/338 |
| 4,223,920 | A | * | 9/1980 | Van Bilderbeek | 285/24 |
| 4,286,665 | A | * | 9/1981 | Walker | 166/339 |
| 4,399,872 | A | * | 8/1983 | McConaughy et al. | 166/341 |
| 4,457,378 | A | * | 7/1984 | Watkins | 166/347 |
| 4,629,003 | A | * | 12/1986 | Baugh | 166/341 |
| 4,643,616 | A | * | 2/1987 | Castel et al. | 405/191 |
| 4,730,677 | A | * | 3/1988 | Pearce et al. | 166/345 |
| 4,809,784 | A | * | 3/1989 | Besnard | 166/340 |
| 5,992,526 | A | * | 11/1999 | Cunningham et al. | 166/343 |
| 6,032,742 | A | * | 3/2000 | Tomlin et al. | 166/345 |
| 6,062,312 | A | * | 5/2000 | Wilkins | 166/340 |
| 6,161,618 | A | | 12/2000 | Parks | 166/351 |
| 6,336,508 | B1 | * | 1/2002 | Guinn | 166/339 |
| 6,474,416 | B2 | * | 11/2002 | Beall et al. | 166/343 |

* cited by examiner

*Primary Examiner*—Robert E. Pezzuto
*Assistant Examiner*—Thomas A. Beach
(74) *Attorney, Agent, or Firm*—Buskop Law Group, P.C.; Wendy Buskop

(57) ABSTRACT

The invention is a subsea umbilical termination assembly (UTA) for use with a launch system mounted on a vessel, wherein the UTA involves a lift point, a guide surrounding a connector attached to the lift point, a housing with a mandrel for engaging the connector and at least one interface, numerous flying leads connected to the housing, a base for the housing, and an emergency quick disconnect connected to the mandrel, wherein the disconnect has a hydraulic connector that engages hydraulic pistons that can then disengage numerous locking dogs enabling the hydraulic connector to disengage from the UTA, and wherein the interface in the housing connects to an electrical umbilical, a fiber optic cable, or hydraulic umbilical.

10 Claims, 7 Drawing Sheets

26

31
22
68
82
76
70
74
79
77
66
78
81
80
83
85
54
105
103
102
63
52
101
65
100
62
64

UMBILICAL TERMINATION ASSEMBLY AND LAUNCHING SYSTEM

FIELD OF THE INVENTION

This invention is for a launching system, method of use, and umbilical termination assembly usable with subsea wells and Christmas trees and related subsea equipment used in the offshore oil and natural gas industry. The invention has the advantage of being able to test and control subsea equipment in series without the need to bring the testing or control equipment, such as an umbilical termination assembly, to the surface after each test or control period.

BACKGROUND OF THE INVENTION

The present invention has been created to provide a method of safely launching and using an umbilical termination assembly for a series of tests or control situations under water.

The present invention specifically relates an umbilical termination assembly, which can be used to continually perform subsea Christmas tree testing and control while maintained in a submerged situation.

The invention solves a long felt need for a launch system which can be mounted on a floating vessels or even a platform, such as a tension leg platforms (TLP), a deep draft caisson vessels (SPAR), a fixed platforms, a compliant towers, semisubmersible vessels, or other floating vessels and used to launch and retrieve subsea equipment, such as an umbilical termination assembly.

SUMMARY OF THE INVENTION

The invention relates to a launch system for use in controlling subsea equipment, comprising: a winch mounted on a vessel; a movable boom mounted near the winch on the vessel for receiving cable from the winch and guiding that cable to a subsea tool; at least one reel mounted near the moveable boom on the vessel for storing at least one optical conductor, electrical conductor or hydraulic conductor; at least one sheave disposed on the movable boom for guiding the cable to the subsea tool; at least one actuator mounted on the vessel for pivoting the moveable boom from a predeployed position to a deployed position; a power system mounted on the vessel for the at least one optical conductor, electrical conductor or hydraulic conductor when engaged with the subsea equipment which can be used for recovery of the subsea tool after controlling of the subsea equipment.

The invention also relates to a UTA which comprises: a lift point; a connector connected to the lift point; a guide surrounding the connector; a housing connected to the guide, and further wherein the housing comprises: a mandrel for engaging the connector and at least one interface for connecting between a member of the group: an electrical umbilical, a fiber optic cable, and a hydraulic umbilical; a plurality of flying leads connected to the housing; a base connected to the housing, and an emergency quick disconnect connected to the mandrel, comprising a hydraulic connector which engages hydraulic pistons which can then disengage a plurality of locking dogs, enabling the hydraulic connector to disengage from the UTA.

Finally the invention relates to a method of lowering a UTA or similar subsea tool to subsea equipment for control and or testing using a movable boom wherein the method comprises the steps of: (1) connecting the UTA to a hydraulic conductor connected to a hydraulic system; (2) connecting the UTA to an electric conductor connected to a power system; (3) connecting the UTA to an optical conductor connected to an optical communication system; (4) removably connecting the UTA to a winch cable which is connected to a winch wherein the winch cable passes through a sheave mounted on a moveable boom in a predeployment position, wherein the boom is mounted on a vessel; (5) simultaneously, picking up the UTA using the winch, and moving the moveable boom with an actuator from the moveable boom's predeployment position to a deployed position; (6) performing a controlled descent of the UTA from the vessel to subsea equipment using the winch; (7) disconnecting interfaces from the UTA and attaching flying leads to the subsea equipment; (8) controlling and testing the subsea equipment via the UTA from the vessel; and (9) disengaging the interfaces from the subsea equipment, once control and testing is complete, for use on a subsequent subsea equipment.

DETAILED DESCRIPTION OF THE INVENTION

Figure 1:
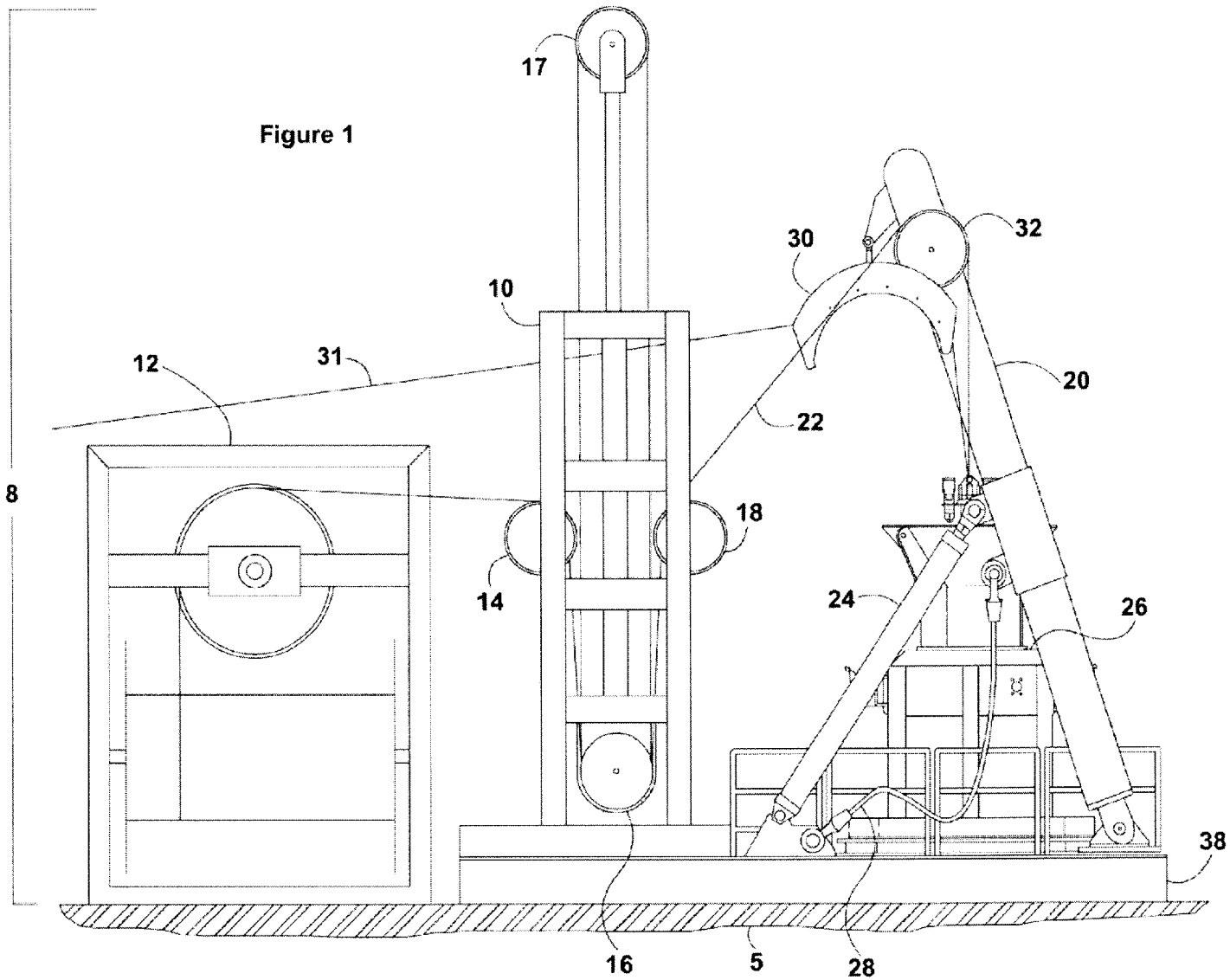
FIG. 1 is a side view of the invention in predeployment position.

The invention relates to a launch system and subsea tools for use during subsea operations of the present invention which can be used with a variety of production vessels and even with production platforms, such as floating production platforms.

The invention relates to a deployment and retrieval vehicle, which can be attached to an offshore platform or a floating vessel and successfully eliminates the risk of collision between equipment and piping passing through the moon pool and equipment which can be successfully passed over the side of a vessel. This device significantly improves the health, safety and operating environment on an offshore rig or vessel while enabling continuing drilling, completion, production workover or decompletion operations. This device improves the working conditions by reducing accidents that can occur because of too many pipes and other devices passing through the moon pool of the vessel.

The invention relates to a method of deploying and retrieving a subsea tool wherein the tool can be used over and over, without having to surface, to test and control wells and other subsea equipment.

The invention has significant health, safety and environmental advantages over other systems which require the constant deployment and retrieval of subsea tools, such as a tree running tool mounted umbilical termination assembly or (UTA). This invention can be used on a wide variety of subsea equipment, including but not limited to a subsea oil well, or subsea Christmas Tree, a subsea natural gas well, a subsea water injection well, a subsea gas injection well, a subsea manifold, a flowline skid, and combinations of these.

Each launch can cause an accident, each retrieval can be an exposure to liability. This invention reduces the chance of accidents by enabling the subsea tool for control and or testing to launch one time only then remain underwater and permit testing and control in sequence with a single retrieval after the project is completed.

The invention is for a launch system for use in controlling subsea equipment, which comprises, a winch mounted on a vessel; a movable boom mounted near the winch on the vessel for receiving cable from the winch and guiding that cable to a subsea tool; at least one reel mounted near the moveable boom on the vessel for storing at least one optical conductor, electrical conductor or hydraulic conductor; at least one sheave disposed on the movable boom for guiding the cable to the subsea tool; at least one actuator mounted on the vessel for pivoting the moveable boom from a predeployed position to a deployed position; a power system mounted on the vessel for the at least one optical conductor, electrical conductor or hydraulic conductor when engaged with the subsea equipment which can be used for recovery of the subsea tool after controlling of the subsea equipment.

It is within the scope of this invention, that that actuator can be a pneumatic cylinder, an electric motor, a plurality of mechanical linkages, gears, a hydraulic cylinder, and combinations of these devices.

The winch of the invention can be a pneumatic winch, a hydraulic winch, an electric winch, combinations of these winches, or winches with motion compensators attached. The most preferred winch has a rated working load capable of supporting no less then the weight of the cable and the weight of the subsea tool, which, in the invention is most preferably an umbilical termination assembly or UTA as it will be referred to throughout.

The launch system can further include a motion compensator mounted on the floating vessel. The motion compensator can be any number of types of usable motion compensators, such as a heave compensator.

The launch system can utilize one or a plurality of reels. One reel can be used which holds both an electrical umbilical and a hydraulic umbilical. However, two or more reels can also be used with each reel using that combination of umbilicals, or separate hosting a hydraulic umbilical or an electric umbilical. Fiber optic cable can be used as well with the launch system for the subsea tool and one or more reels can also hold and release fiber optic cable.

This invention has been conceived so that a launch system can be used for the controlling of the subsea equipment, particularly where that "controlling" is the connecting to and testing of subsea equipment in series while submerged. The most preferred subsea equipment that this system is contemplated for is the Christmas trees of oil, natural gas and injection wells.

The launch system has a moveable boom, which can be mounted to the deck directly of the floating vessel such as with turnbuckles or the like, or it can be skid mounted, on a platform. If a platform is contemplated, one embodiment contemplates that the platform has rails mounted to it. The rails are disposed over wheels or rollers mounted on the deck or on yet another platform, enabling the platform to be easily movable and retractable and extendable. The extendable platform is contemplated to be extendable using hydraulic power, pneumatic power, mechanical power, electrical power, and manual power. The extendable platform can be constructed from one or more of a variety of usable materials, which can include fiberglass, steel, aluminum, and carbon fiber composite.

It is also contemplated that the boom of the invention could be a rigid structure, and made of solid steel, which could be usable in conditions of bad weather. However, for geographic locations where weather is not as bad, a folding boom or collapsible boom is contemplated. The boom is also contemplated to be made from hollow tubes, or piping, as well as from square tubing or piping, or any other shape material, which can withstand offshore conditions. The boom is contemplated to be configured in a shape, which can be a conventional boom, having a linear shape, or any of a number of other shapes. Shapes which would work include a boom which is U-shaped, square-shaped, C-shaped, rectangularly-shaped, ellipseoidally-shaped, and triangularly-shaped. The most preferred embodiment contemplates an inverted U-shaped moveable boom.

The power system usable with the launch system is contemplated to be either a hydraulic power source, a pneumatic power source, an electrical power source, or combinations of these power systems. Power also may be provided from power packs. The launch system of claim 1, further comprising a safety cable secured to the moveable boom to keep the moveable boom from collapsing. An additional power source is contemplated to run the winch.

Clamps can be used in this invention to connect together the winch cable, and the conductors or umbilicals of electricity, hydraulics and fiber optics.

A preferred embodiment is shown in the attached Figures. Referring now to FIG. 1, one embodiment of the invention is shown. A launch system 8 is mounted on a platform 38 having a heave compensator 10. The heave compensator 10 can be a hydraulically controlled heave compensator.

A winch 12, which can be a stand-alone winch, is used to raise and lower the UTA 26 (umbilical termination assembly). Optionally, the winch can be connected to platform 38. The winch 12 uses a cable 22 to raise and lower the UTA. A plurality of sheaves is used to guide the cable 22 from an attaching point on the winch 12 to the UTA 26. A first sheave 14 is an entry sheave, a second sheave 16 is a motion compensator fixed sheave, and a third sheave 18 is the exit sheave, can be secured to a motion compensator 10. A fourth sheave can be used, the motion compensator 10's dynamic sheave, 17, is mounted on the motion compensator. These sheaves provide the proper alignment for the cable during deployment and retrieval.

A boom 20 is used. FIG. 3 shows the boom 20 shape as an inverted U-shape however, it could be triangularly shaped or C shaped to assist in the raising and lowering of the UTA. The boom 20 is movable and preferably attached to hydraulic cylinders 24 and 25. The hydraulic cylinders 24 and 25 (shown in FIG. 5) are used to pivot the moveable boom 20 from a predeployed position (shown in FIG. 1) to a deployed position (shown in FIG. 2).

Figure 5:
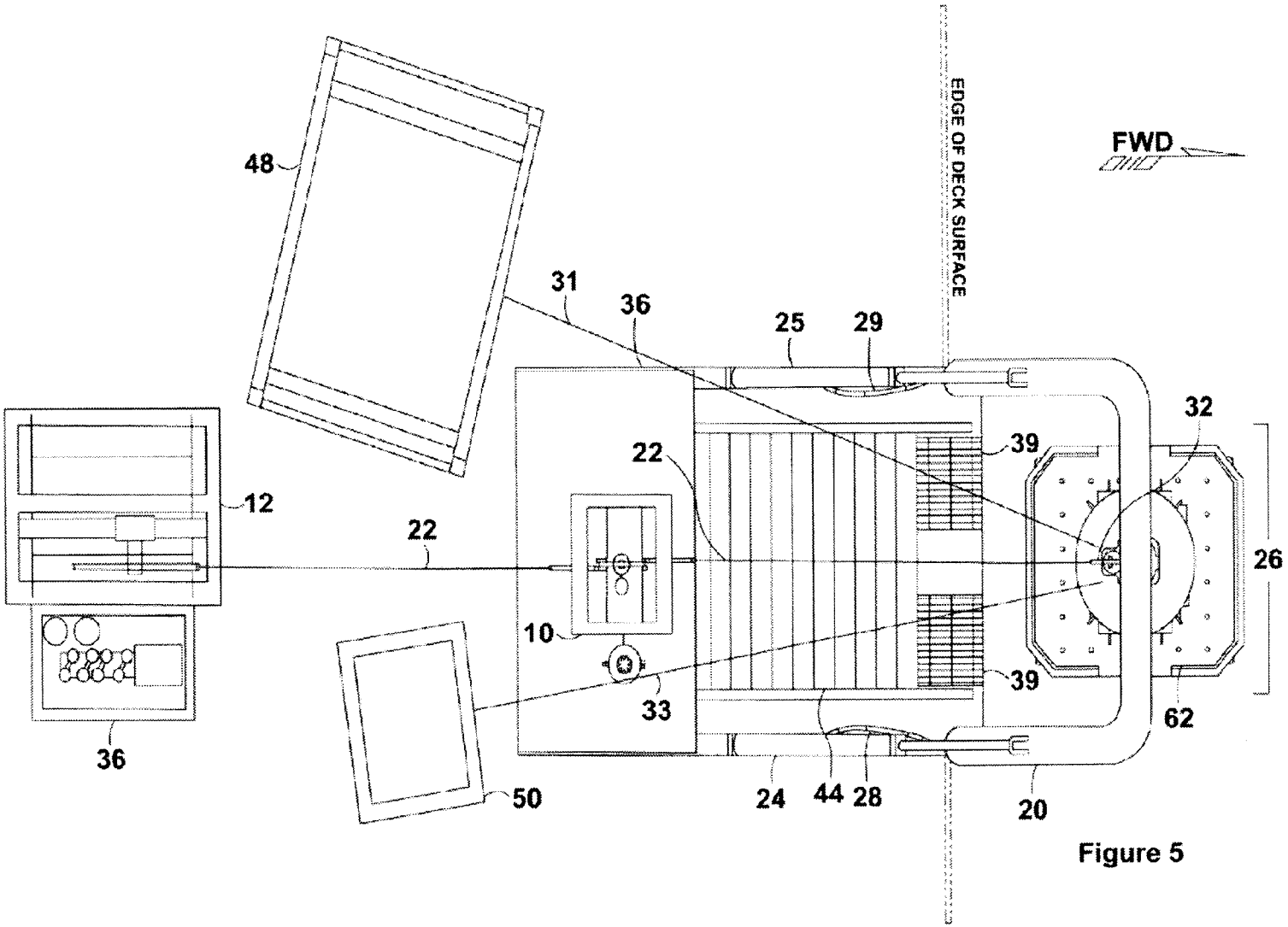
FIG. 5 shows a top view of the invention in deployed position on the deck of a vessel.

Referring now to FIG. 1, the hydraulic cylinder 24 is secured on one end to the equipment platform 38, which is attached to deck 5 of the vessel, and on the other end the hydraulic cylinder 24 is connected to the boom 20. Two safety cables 28 and 29 (cable 28 is shown in FIG. 1, and both cables are shown in FIG. 5) are used to prevent the moveable boom 20 from falling into the sea if the hydraulic cylinders fail to provide the necessary support to the boom 20.

A cable sheave 32 is positioned on the boom 20. An umbilical sheave 30 is on the boom 20 and used for guiding a hydraulic umbilical 31 (which is shown in more detail in FIG. 3) to the UTA 26. An electrical sheave 34 is used for guiding an electrical umbilical 33 to the UTA 26. All three sheaves are shown in FIG. 3.

Returning to FIG. 2, in this embodiment platform 38, further includes an extendable work platform 39. The extendable work platform 39 is preferably hydraulically extendable, and may be made from steel, or other durable material. This extendable platform may have a grate construction or may have a solid construction.

The UTA 26 enables the testing in series of the subsea equipment while remaining submerged. The UTA has a lift point; which can be a pad eye. A connector is connected to the lift point, although a hollow cylinder can be disposed between the pad eye or lift point and the connector. A guide surrounds the connector. The guide is preferably in the shape of a funnel, by any appropriate guide means, preferably also using a self alignment key is contemplated as usable. The current preferred embodiment contemplates a funnel with a conical shape, with the widest part of the cone oriented to the lift point and the more narrow part of the cone oriented in the other direction. A housing is contemplated connecting to the guide. The housing is preferably made from steel, like the funnel and the lift point. The housing further contains a mandrel for engaging the connector and at least one interface for connecting between one or more umbilicals or fiber optics, such as electrical umbilicals, a fiber optic cable, and hydraulic umbilicals. The UTA has a plurality of flying leads connected to the housing. The housing then sits on a base, which can be a plate of steel or metal, or a perforated structure, like a H design or a grid design. This base can be distanced away from the housing by using steel I-beams or similar means which would provide a space between the housing and the base. The use of the legs, or supports, provides space so that a diver or ROV could obtain easy insertion into the UTA to connect or quickly disconnect the UTA from a Christmas tree, such as in the case of an impending Tsunami or hurricane.

The emergency quick disconnect feature of the UTA is a component or hydraulic connector which is connected to the mandrel. This quick disconnect feature includes a hydraulic connector which engages hydraulic pistons which can then disengage a plurality of locking dogs, enabling the hydraulic connector to disengage from the UTA. It is possible that other than a hydraulic connector could be used for the quick disconnect feature, such as a mechanical connector or electrical connector or combinations of those connectors.

The UTA has a further embodiment, wherein the base may further have at least one, and a number, up to 20 or more, and most preferably four stabilizing connections. In the preferred embodiment, the stabilizing connections are located on each corner of the base to add stability to the UTA.

The UTA base is contemplated to have as an embodiment, the ability to provide storage for one or more of electrical, hydraulic or fiber optic flying leads. Additionally, it is contemplated that the base is constructed from a structurally sturdy material such as concrete, carbon fiber, steel, or combinations of these.

Returning to FIG. 2, the UTA 26 is shown connected to the cable 22 by a pad eye 68. The pad eye 68 is secured to a hollow shaft 70, which optionally connects to the hydraulic connector 74 (shown in FIG. 6).

Figure 7:
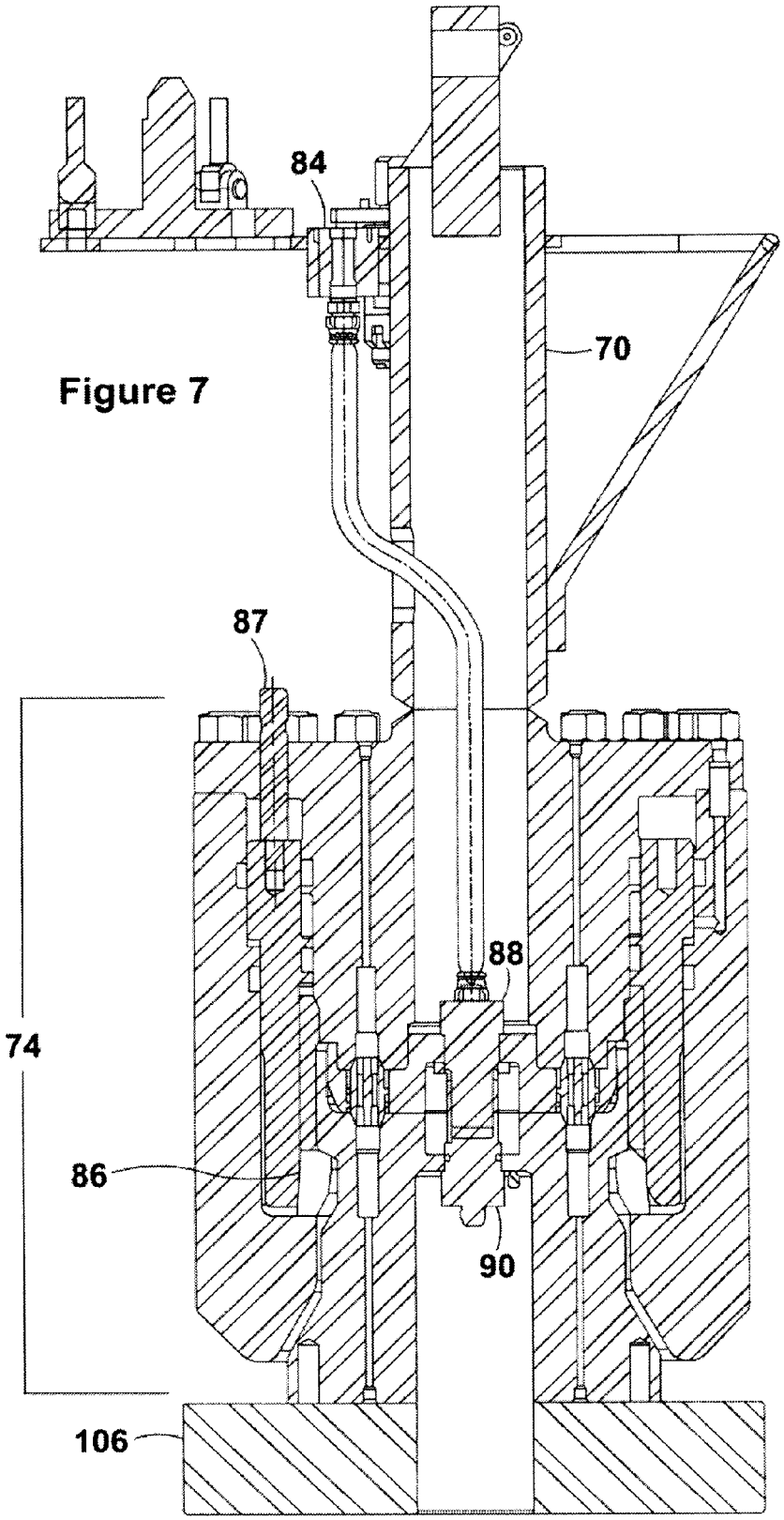
FIG. 7 shows a detail of the hydraulic connector and the mandrel of the invention.

A guide 76, having the preferred shape of a funnel partially surrounds the hollow shaft 70. The hydraulic connector 74 sits within the guide 76. The guide rests on housing 66, which contains a mandrel, which is shown in FIG. 7. Also in FIG. 7, are shown interfaces between the electrical and hydraulic umbilical to the junction plates. The electrical interface 85 and the hydraulic interface 81 can be connected to the subsea equipment easily using an ROV or a diver.

Figure 2:
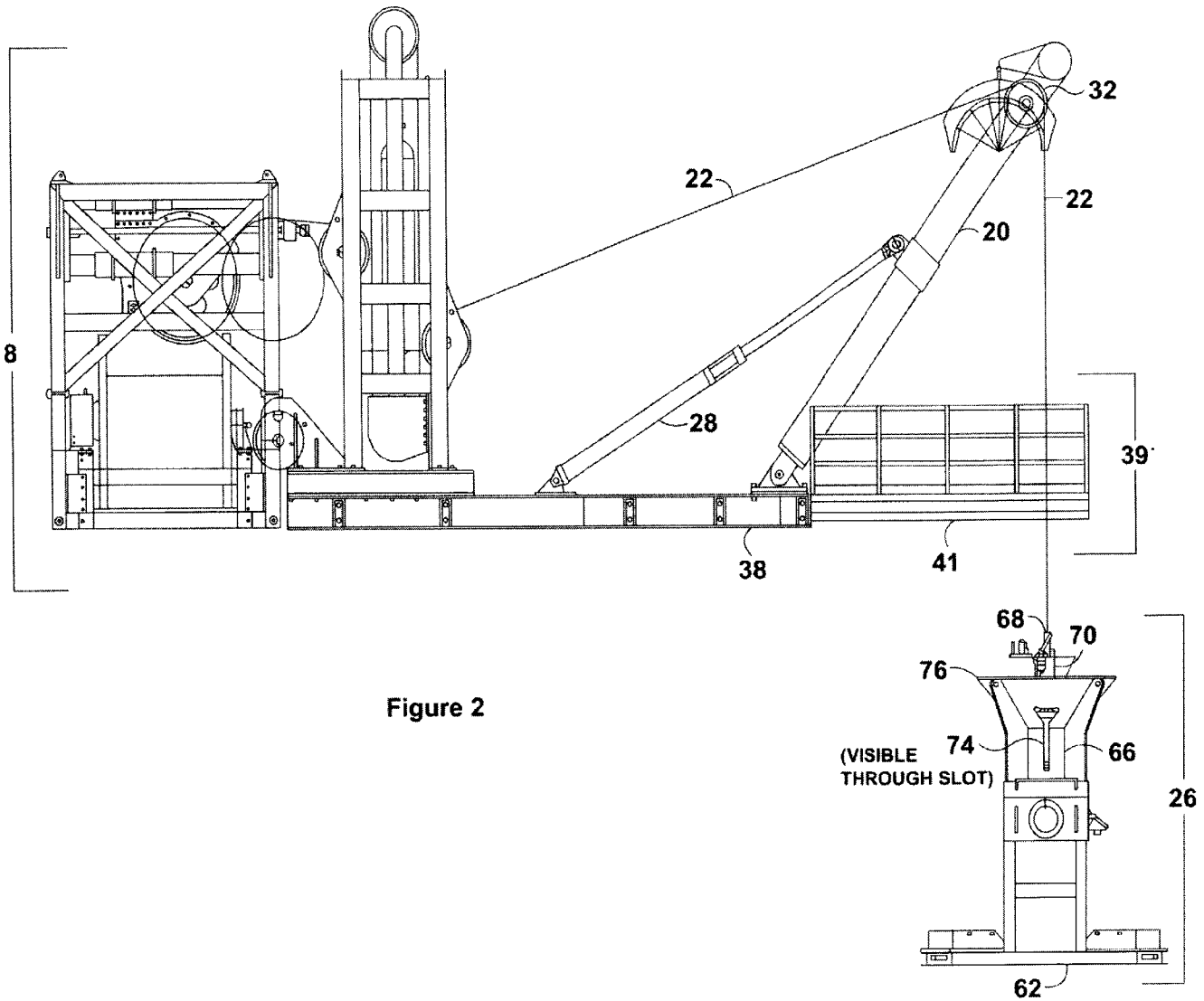
FIG. 2 is a side view of the invention in deployed position.
Figure 3:
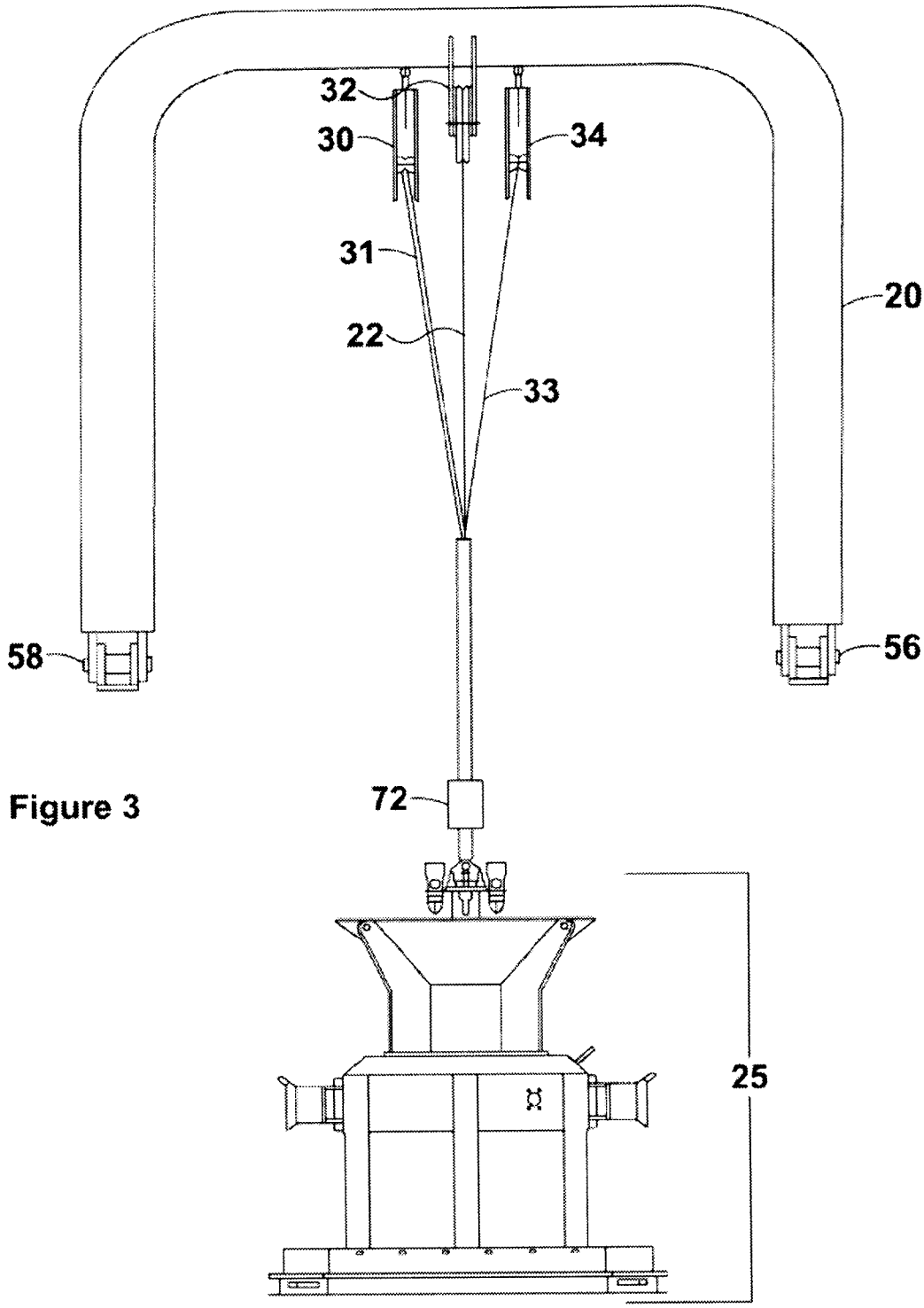
FIG. 3 is a front view of the invention in deployed position.

Back in FIG. 2, housing 66 is connected on the other end to the base 62 of the UTA 26.

It is considered within the scope of the invention to that the sides of the base 62 be used as storage for the hydraulic flying leads and electrical flying leads (not shown) of the UTA 26.

FIG. 3 shows a front view of a boom 20 with three sheaves, 30, 32, and 34. Boom 20 is shown in this embodiment as connected to the platform by pivots or turnbuckles 58 and 56. A clamp 72 is used to connect together, the electrical umbilical 33, hydraulic umbilical 31 and winch cables 22.

Figure 4:
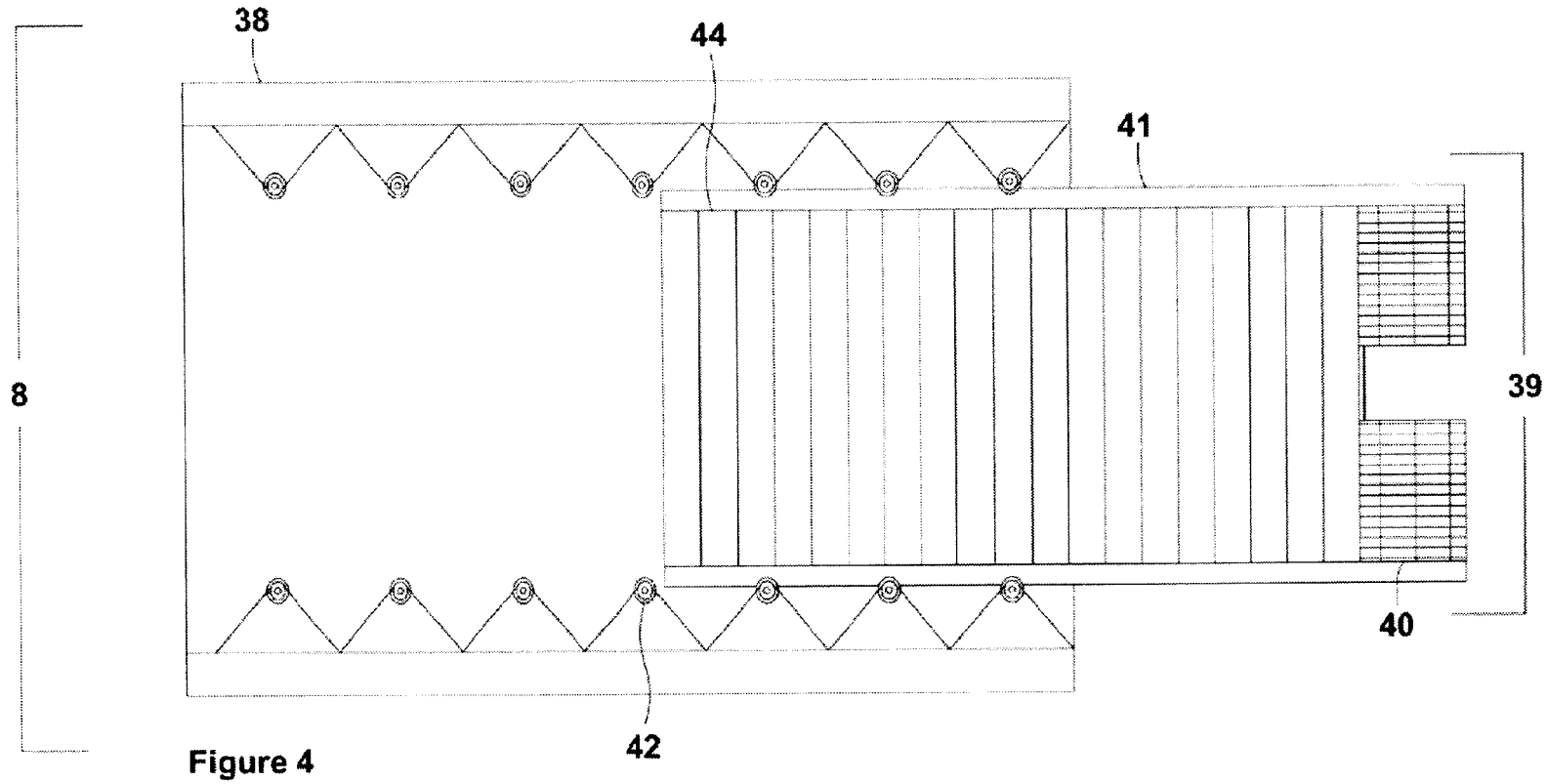
FIG. 4 is a detail of a top view of the invention of FIG. 2.

FIG. 4 shows a top view of the launch system 8 wherein platform 38 has rolling platform 39 constrained within the confines of platform 38. Rolling platform 39 is shown in the deployed position. The rolling platform 39 can be an optional component of the launching system 8 and helpful from a safety perspective. Rolling platform 39 can optionally roll on rails (41), but it can contain rails mounted on the extendable platform 39 and roll on rollers 42 secured to the deck FIG. 2 shows the rail embodiment, with rail 41 represented. The rolling platform 39 can have a grating 40, or perforated metal structure, which can be used to support personnel or equipment.

FIG. 5 shows a winch power pack, or power system 36, which is connected to and runs winch 12. This FIG. 5 also provides an embodiment, wherein platform 39 is covered with wood slats 44.

FIG. 5 also shows a hydraulic umbilical reel 48 connected to the hydraulic umbilical 31. An electrical down line 50, or electrical umbilical reel 50 connects to electrical umbilical 33. FIG. 5 also shows hydraulic cylinders 24, 25, safety cables 28, 29 as well as boom 20.

The structure of the UTA is shown in this figure. It should be noted that base 62 of the UTA 26 is preferably steel. Alternatively, it is within the scope of this invention that the base can be either of a plate construction or possibly a sturdy frame made of solid steel I-beams welded together or a perforated metal structure. Alternatively, the frame may be tubular metal. A platform 38 with extension 39 is also shown. Motion compensator 10 is between winch 12 and the cable sheave 32 and cable 22 runs through the sheave 32.

Figure 6:
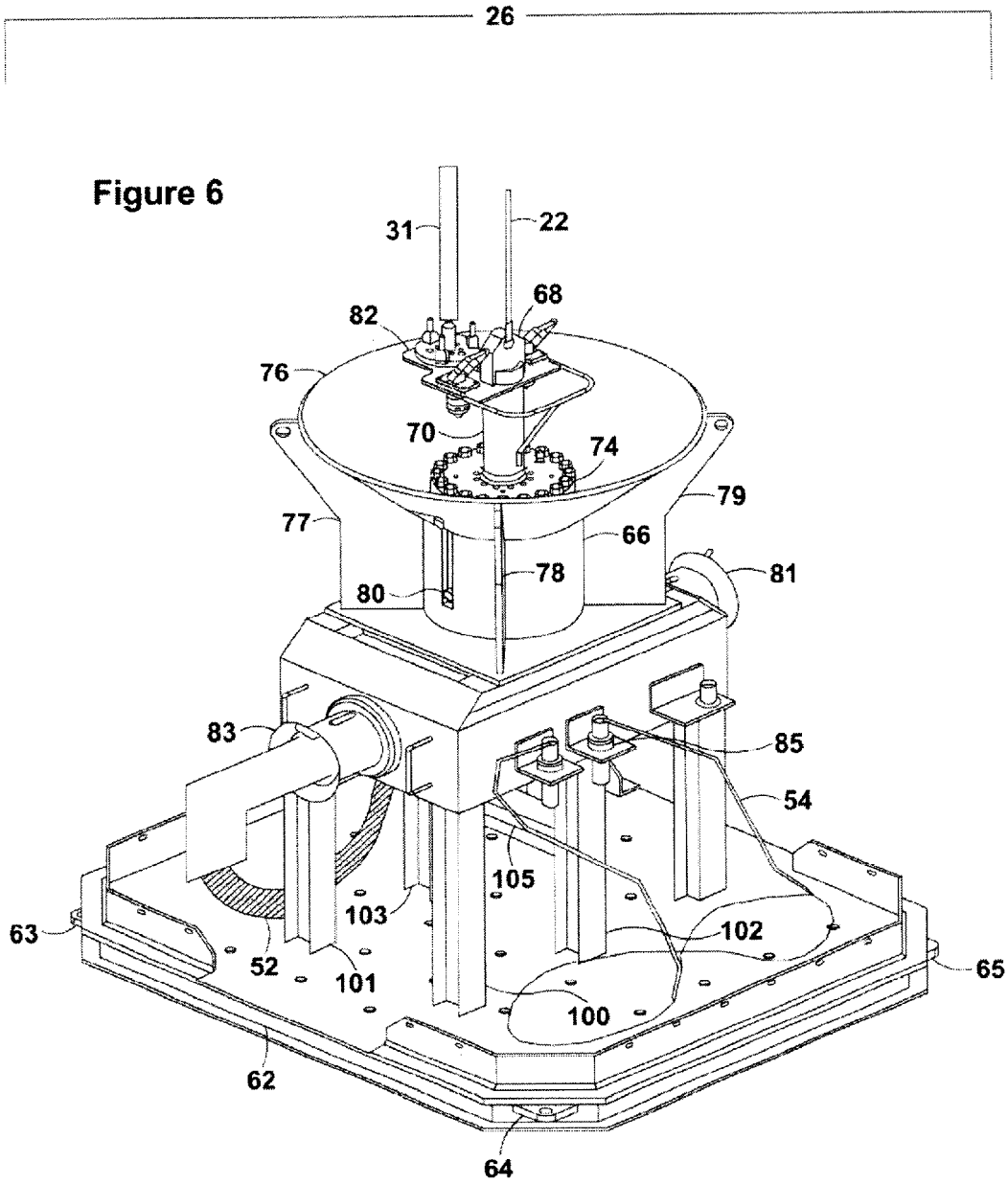
FIG. 6 shows a detail of the umbilical termination assembly of the invention.

FIG. 6 shows the UTA 26 having a pad eye 68 for connecting to the winch cable 22 and the hollow cylinder 70. The UTA 26 has a base 62, with stabilizing connectors, which could be pad eyes at each corner of the base 63, 64 and 65, with the fourth connector not shown. It is within the scope of the invention to use only one stabilizer connector on the UTA base.

Hydraulic connector 74 has a guide funnel 76, which is supported by at least three gussets 77, 78, and 79. In this Figure, three gussets are shown preferably 4 gussets would be used within the scope of the invention. An alignment key 80 is used to align the connector 74 as it goes into the guide funnel 76. The connector 74 acts as an emergency quick disconnect mechanism. The connector 74 engages the mandrel. When release is needed, the connector 74 receives hydraulic fluid. The hydraulic fluid flows against piston, which then pushes and cause the plurality locking dogs to releases to that the hydraulic connector can be disengaged from the UTA.

A hydraulic quick connect plate 82 attaches to the hydraulic umbilical 31.

A hydraulic interface 83 connected to a hydraulic flying lead 52. Electric flying leads 54 are secured to an electrical interface 85.

A plurality of housing supports 100, 101, 102, 103, 104, and 105 can be used to keep the housing 66 and hydraulic connector 74 apart from the base 62, so that a diver or an ROV has accessibility to the hydraulic or electric flying leads for easy connection. These supports help the connector 74 remain the required distance away from the platform for ease of use with an ROV.

FIG. 7 is a detailed side view of the connector 74. Electric power connector 84 engages with a subsea matable electrical connector 88, via the hollow shaft 70. A hydraulic connector-locking ring 86, typically has 8–10 locking dogs, and locks the connector onto the mandrel 106. Up to 12 hydraulic connectors can be used for this size body but additional hydraulic connectors can be used on larger connector bodies.

A visual indicator 87 can be used to insure that secure locking occurs for the connectors.

Additionally, seals, such as metal-to-metal seals, elastomeric seals, or a combination of seals can be used in this invention with any one or all of the connections. Two (2) inch to twelve (12) inch connectors is used within the scope of this invention. However, a nine (9) inch connector is the most preferred embodiment.

Cable of various materials can be used in this invention. It is contemplated to use steel cable, non-rotating cable, synthetic man-made fiber cables and other for this launching system.

The invention also contemplates a method for lowering a UTA to subsea equipment using a movable boom comprising the steps of: (1) connecting the UTA to a hydraulic conductor connected to a hydraulic system; (2) connecting the UTA to an electric conductor connected to a power system; (3) removably connecting the UTA to a winch cable which is connected to a winch wherein the winch cable passes through a sheave mounted on a moveable boom in a predeployment position, wherein the boom is mounted on a vessel; (4) simultaneously, picking up the UTA using the winch, and moving the moveable boom with an actuator from the moveable boom's predeployment position to a deployed position; (5) performing a controlled descent of the UTA from the vessel to subsea equipment using the winch; (6) disconnecting interfaces from the UTA and attaching flying leads to the subsea equipment;(7) controlling and testing the subsea equipment via the UTA from the vessel; and (8) disengaging the interfaces from the subsea equipment, once control and testing is complete, for use on a subsequent subsea equipment.

The method further contemplates having the step of connecting a fiber optic cable to the UTA.

In another embodiment of the method, it is contemplated that the interfaces can be connected to one or more of the following devices: a pressure transducer, a temperature transducer; a flow sensor, a choke, a pig detector, a sand detector, a smart well device, or combinations of these devices. Additionally, in the connecting step for the interfaces, the interfaces can be connected to a subsea control module, a running tool; a flying lead deployment running tool, a choke running tool, an insert tool, and combinations of these. The interfaces can be engaged or disconnected using an ROV or a diver or both.

Variations can occur within the scope of this invention and various methods for using the equipment are contemplated within the scope of this invention.

It will be appreciated by one skilled in the art based on this disclosure that variations and modifications may be made to the embodiments of the invention without departing from the spirit or scope of the invention as set forth in the accompanying claims. It is intended that all such variations and modifications fall within the scope of the present invention as claimed.

Further features and advantages of the invention will be apparent from the specification and the drawing.

What is claimed is:

1. A subsea umbilical termination assembly (UTA) for use with a launch system mounted on a vessel, wherein said UTA comprises:

i. a lift point;

ii. a connector connected to said lift point;

iii. a guide surrounding the connector;

iv. a housing connected to said guide, and further wherein said housing comprises: a mandrel for engaging the connector and at least one interface for connecting between a member of the group: an electrical umbilical, a fiber optic cable, and a hydraulic umbilical;

v. a plurality of flying leads connected to said housing;

vi. a base connected to said housing, vii. an emergency quick disconnect connected to the mandrel, comprising a hydraulic connector which engages hydraulic pistons which can then disengage a plurality of locking dogs, enabling the hydraulic connector to disengage from the UTA.

2. The subsea umbilical termination assembly of claim 1, wherein said lift point is a pad eye.

3. The subsea umbilical termination assembly of claim 1, wherein said guide is a funnel.

4. The subsea umbilical termination assembly of claim 1, wherein said base further comprises four stabilizing connections, each disposed on a corner of said base to add stability to the UTA.

5. The subsea umbilical termination assembly of claim 1, wherein said base provides storage for said plurality of flying leads.

6. The subsea umbilical termination assembly of claim 5, wherein said flying leads are members of the group: hydraulic flying leads, fiber optic flying leads, and electrical flying leads.

7. The subsea umbilical termination assembly of claim 1, wherein said connector is selected from the group: hydraulic connector, mechanical connector, and combinations thereof.

8. The subsea umbilical termination assembly of claim 1, wherein said base is constructed from a material selected from the group: concrete, carbon fiber, steel, and combinations thereof.

9. The subsea umbilical termination assembly of claim 1, wherein said base is a plate.

10. The subsea umbilical termination assembly of claim 1, wherein said base is a perforated metal structure.

* * * * *